US007147282B2

(12) United States Patent
Hatcher et al.

(10) Patent No.: US 7,147,282 B2
(45) Date of Patent: Dec. 12, 2006

(54) CHAIR WITH BACKREST DEPTH ADJUSTMENT MECHANISM

(75) Inventors: Stephen D. Hatcher, Jasper, IN (US); Michael L. Deimen, Holland, IN (US)

(73) Assignee: Kimball International, Inc., Jasper, IN (US)

( * ) Notice: Subject to any disclaimer, the term of this patent is extended or adjusted under 35 U.S.C. 154(b) by 103 days.

(21) Appl. No.: 10/983,348

(22) Filed: Nov. 8, 2004

(65) Prior Publication Data

US 2006/0097554 A1 May 11, 2006

(51) Int. Cl.
*A47C 7/02* (2006.01)

(52) U.S. Cl. ..... 297/230.14; 297/323; 297/353; 297/230.13; 297/300.2; 297/284.1

(58) Field of Classification Search ..... 297/383, 297/353, 323, 452.18, 230.14, 284.1, 230.13, 297/300.2

See application file for complete search history.

(56) References Cited

U.S. PATENT DOCUMENTS 3,576,347 A * 4/1971 Vivian et al. ..... 297/383
5,009,466 A * 4/1991 Perry ..... 297/323
5,249,839 A * 10/1993 Faiks et al. ..... 297/300.1
5,364,162 A 11/1994 Bar et al. ..... 297/284.8
5,385,388 A * 1/1995 Faiks et al. ..... 297/301.3
5,593,211 A 1/1997 Jay et al. ..... 297/383
5,788,328 A 8/1998 Lance ..... 297/284.4
6,179,384 B1 * 1/2001 DeKraker et al. ..... 297/284.4
6,471,294 B1 * 10/2002 Dammermann et al. . 297/284.7
6,523,898 B1 * 2/2003 Ball et al. ..... 297/320
6,598,937 B1 * 7/2003 Caruso et al. ..... 297/353
6,811,218 B1 * 11/2004 Deimen et al. ..... 297/284.1
6,877,812 B1 * 4/2005 Congleton et al. ..... 297/353
2003/0127896 A1 7/2003 Deimen et al. ..... 297/301.1
2003/0137171 A1 7/2003 Deimen et al. ..... 297/284.1
2004/0108763 A1 6/2004 Congleton et al. ..... 297/353
2004/0189073 A1 * 9/2004 Chadwick et al. ..... 297/383

* cited by examiner

*Primary Examiner*—Peter M. Cuomo
*Assistant Examiner*—Erika Garrett
(74) *Attorney, Agent, or Firm*—Baker & Daniels LLP

(57) ABSTRACT

A backrest depth adjustment mechanism which allows adjustment of the backrest assembly in a front-to-back manner with respect to the seat. The backrest assembly generally includes a backrest frame supporting the backrest. The backrest frame includes opposite end portions, and at least one of the end portions includes a backrest depth adjustment mechanism. The backrest depth adjustment mechanism includes a stationary portion and a movable portion, wherein the movable portion is movable with respect to the stationary portion. An actuator mechanism allows the user to actuate the backrest depth adjustment mechanism to move the backrest to a desired depth position.

26 Claims, 5 Drawing Sheets

CHAIR WITH BACKREST DEPTH ADJUSTMENT MECHANISM

BACKGROUND OF THE INVENTION

1. Field of the Invention

The present invention relates to chairs, and in particular, to a backrest assembly for a task chair, the backrest assembly including a backrest depth adjustment mechanism.

2. Description of the Related Art

Task chairs are commonly used by persons while working in a seated position in an office or other occupational environment. Typically, such chairs include a base assembly with caster wheels for rolling movement over a floor surface, a pneumatic cylinder connecting the base assembly to the seat assembly for vertical adjustment, as well as a number of manual adjustment features to allow the user to adjust the position and/or movement characteristics of the chair to a desired configuration.

Many known task chairs include a seat depth adjustment feature, wherein the seat is adjustable in a front-to-back manner with respect to the seat support structure in order to accommodate differently sized users. A disadvantage of this arrangement is that seat depth adjustment mechanisms are often mechanically complex and usually must be integrated with a tilt control mechanism which is located beneath the seat. The integration of the seat depth adjustment mechanism with the tilt control mechanism tends to increase manufacturing difficulties and the overall cost of the chair. Further, the user must reach beneath the chair seat to actuate the seat depth adjustment mechanism.

SUMMARY OF THE INVENTION

The present invention provides a backrest depth adjustment mechanism which allows adjustment of the backrest assembly in a front-to-back manner with respect to the seat. The backrest assembly generally includes a backrest frame supporting the backrest. The backrest frame includes opposite end portions, and at least one of the end portions includes a backrest depth adjustment mechanism. The backrest depth adjustment mechanism includes a stationary portion and a movable portion, wherein the movable portion is movable with respect to the stationary portion. An actuator mechanism allows the user to actuate the backrest depth adjustment mechanism to move the backrest to a desired depth position.

A pin is slidably received within a hole in the stationary portion, and is biased outwardly thereof by a pin spring. A slide member is slidably mounted within a recess of the movable portion and includes a cam surface. An actuator cable controls the position of the slide member. A main spring includes one end connected by an anchor pin to the stationary portion, and an opposite end connected to the movable portion. The pin spring normally biases the pin into engagement with one of the holes in the movable portion to fix the location of the movable portion with respect to the stationary portion, and in turn, the depth position of the backrest. When a user desires to move the backrest in a forward or rearward direction, the user may utilize an actuator mechanism which controls the actuator cable.

When the user desires to move the backrest in a rearward direction, the user actuates the backrest depth adjustment mechanism and places a force against the backrest in a rearward direction, such as by the user leaning back against the backrest. Once the user has reached a desired position, the user releases the actuator mechanism and the backrest will lock into a fixed position. When the user desires to move the backrest in a forward direction, the user actuates the backrest depth adjustment mechanism and removes force from the backrest, such as by the user leaning forward with respect to the backrest, thereby allowing the backrest adjustment mechanism to move the backrest forward via action of the spring which connects the stationary portion to the movable portion of the backrest depth adjustment mechanism. Again, once the user has reached a desired position, the user releases the actuator mechanism and the backrest will lock into a fixed position.

In one form thereof, the present invention provides a chair, including seat support structure; a seat assembly supported by the seat support structure; a backrest assembly, including a generally U-shaped member having a pair of end portions; a backrest supported by the U-shaped member; and a backrest depth adjustment mechanism connecting at least one of the end portions to the seat support structure for generally rectilinear relative movement between the U-shaped member and the seat support structure, the depth adjustment mechanism including a selectively actuable backrest depth position lock mechanism connected between the U-shaped member and the seat support structure.

In another form thereof, the present invention provides a chair, including seat support structure; a seat assembly supported by the seat support structure, the seat assembly including a pair of upwardly-extending side portions; a backrest assembly, including a generally U-shaped member having a pair of end portions pivotally connected to respective the side portions of the seat assembly; a backrest supported by the U-shaped member; and a backrest depth adjustment mechanism associated with at least one of the end portions of the U-shaped member for generally rectilinear relative movement between the U-shaped member and the seat support structure, the backrest depth adjustment mechanism including a selectively actuable backrest depth position lock mechanism connected between the U-shaped member and the seat support structure.

In yet another form thereof, the present invention provides a chair, including seat support structure; a seat assembly supported by the seat support structure; a backrest assembly, including a generally U-shaped member having a pair of end portions, and a backrest supported by the U-shaped member; and a backrest depth adjustment mechanism connecting at least one of the end portions to the seat support structure for generally rectilinear relative movement between the U-shaped member and the seat support structure, the depth adjustment mechanism including a stationary portion connected to one of the end portions and the seat support structure; a movable portion connected to the other of the end portions and the seat support structure, the movable portion selectively movable with respect to the stationary portion whereby a backrest depth position of the U-shaped member and the backrest may be adjusted with respect to the seat assembly; and a selectively actuable backrest depth position lock mechanism connected between the U-shaped member and the seat support structure.

In yet a further form thereof, the present invention provides a chair, including seat support structure; a seat assembly supported by the seat support structure; a backrest assembly, including a frame member; a backrest supported by the frame member; and a backrest depth adjustment mechanism connecting the frame member to the seat support structure for generally rectilinear relative movement between the frame member and the seat support structure, the depth adjustment mechanism including a selectively actuable backrest depth position lock mechanism connected between the frame member and the seat support structure.

In yet a further form thereof, the present invention provides a chair, including seat support structure; a seat assembly supported by the seat support structure; a backrest assembly, including a frame member; a backrest supported by the frame member; and a backrest depth adjustment mechanism connecting the frame member to the seat support structure and including means for selectively adjusting a backrest depth position of the frame member and the backrest with respect to the seat assembly.

BRIEF DESCRIPTION OF THE DRAWINGS

The above-mentioned and other features and advantages of this invention, and the manner of attaining them, will become more apparent and the invention itself will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION

Figure 1:
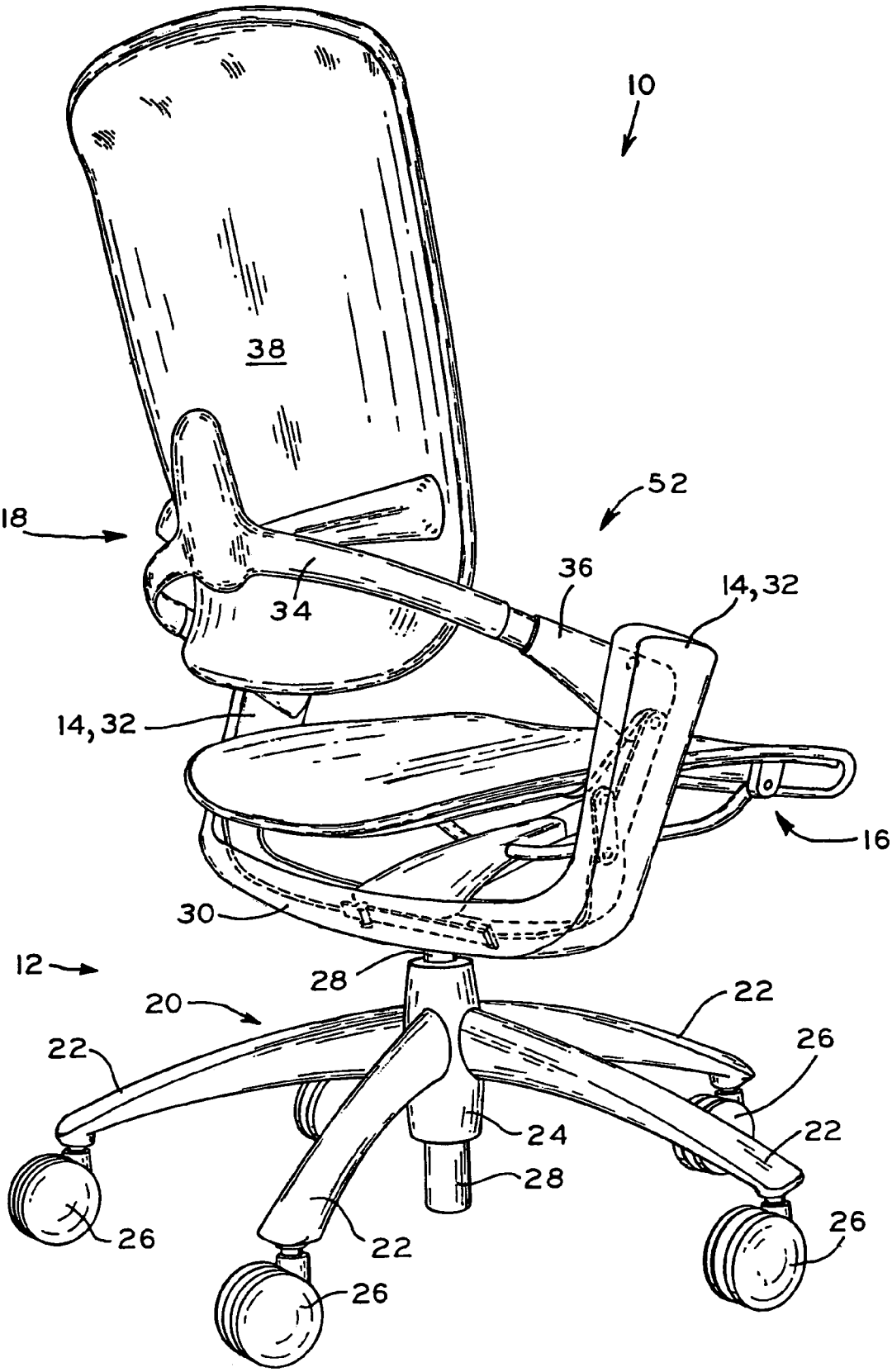
FIG. 1 is a rear perspective view of a task chair including a backrest depth adjustment mechanism according to the present invention.

Referring to FIG. 1, task chair 10 is shown, which generally includes pedestal or base assembly 12, a primary frame or yoke member 14 mounted to base assembly 12, and seat assembly 16 and backrest assembly 18 pivotally mounted to one another and to yoke member 14 for synchronized movement. Base assembly or seat support structure 12 generally includes chair base 20 having a plurality of arms 22 projecting from hub 24, with arms 22 having caster wheels 26 at the ends thereof for rolling movement of chair 10 along a floor surface. Hub 24 of chair base 20 is fitted with a pneumatic cylinder 28 having an upper end thereof secured to yoke member 14 to provide vertical height adjustment of yoke member 14, seat assembly 16, and backrest assembly 18 with respect to base assembly 12 in a manner well known in the art.

Yoke member 14 generally includes transverse beam 30 and a pair of upwardly-extending side portions 32 at opposite ends of transverse beam 30. The upper end of pneumatic cylinder 28 is mounted to transverse beam 30 in a suitable manner, such as by welding or by a press-fit engagement, for example. Although shown in the context of a task chair which includes seat support structure or base assembly 12 having chair base 20 with a plurality of arms 22 projecting from hub 24, the backrest depth adjustment mechanism described herein is equally applicable to a side chair having a seat support structure which includes three or four fixed legs, for example.

Figure 2:
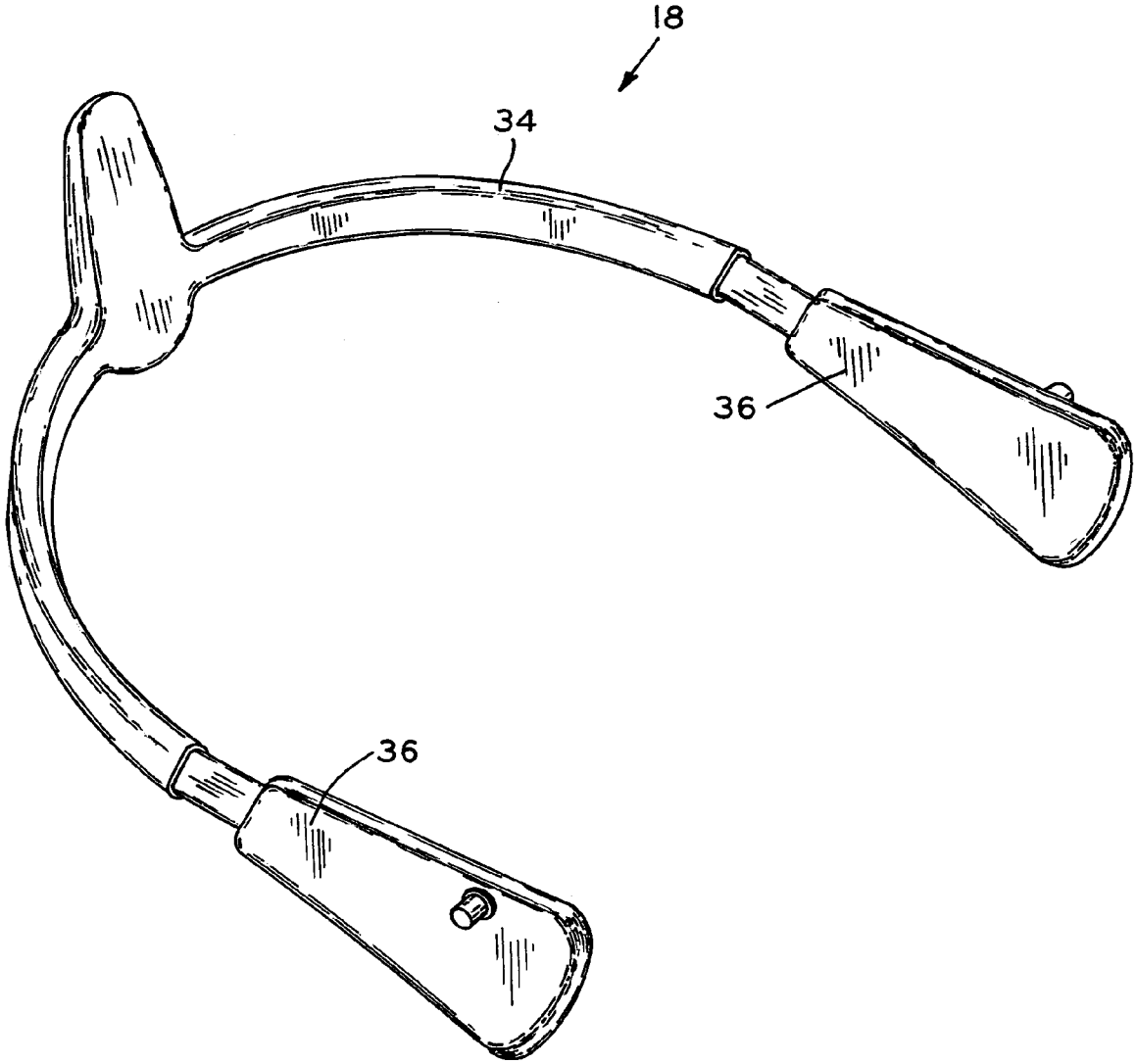
FIG. 2 is a perspective view of the U-shaped backrest frame of the task chair of FIG. 1.
Figure 3:
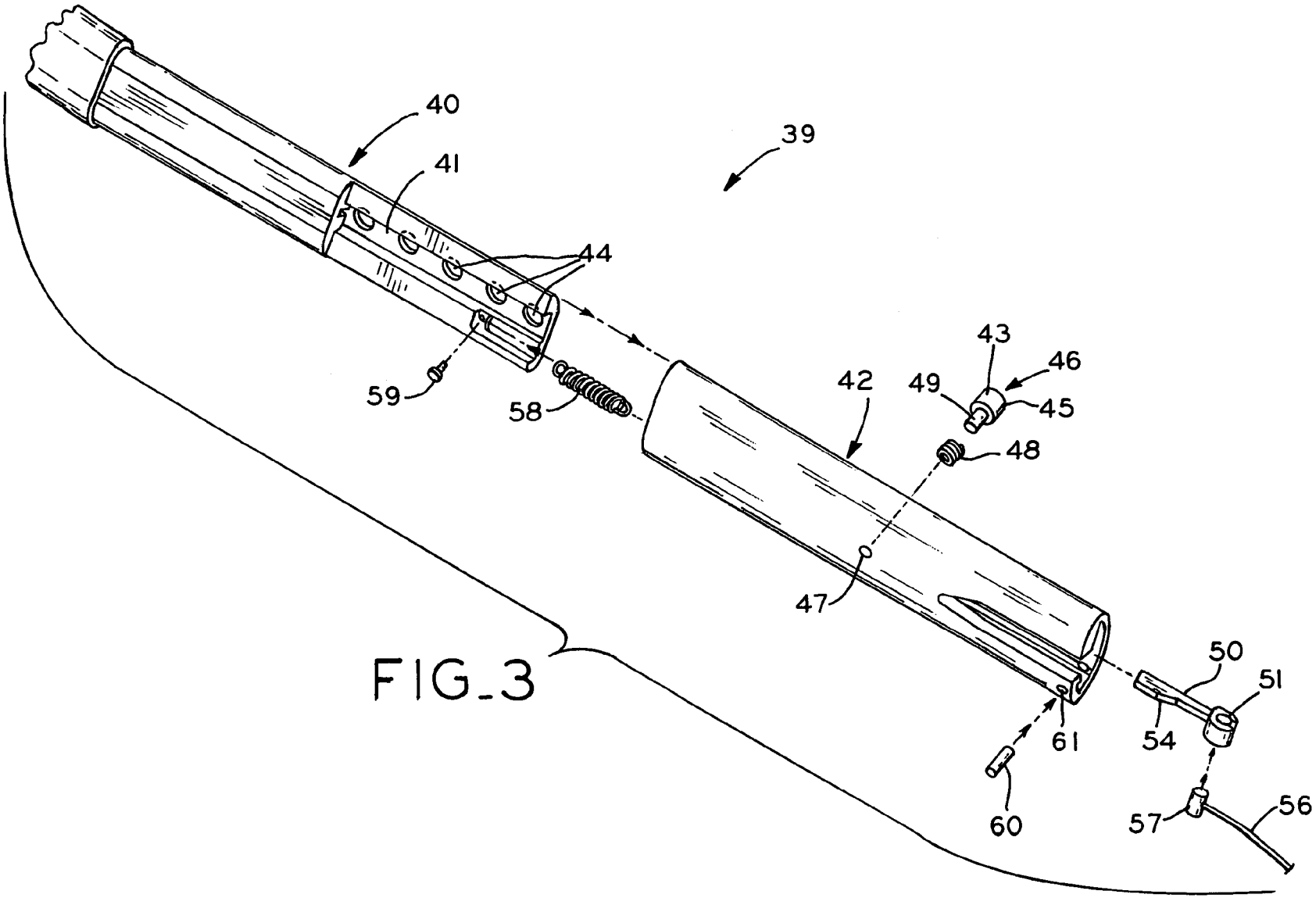
FIG. 3 is an exploded view of one side of the backrest frame of FIG. 2, showing the components of the backrest depth adjustment mechanism.

Referring now to FIGS. 1 and 2, backrest assembly 18 generally includes a substantially U-shaped backrest frame 34 having a pair of end portions 36 pivotally connected to the upper ends of side portions 32 of yoke member 14 and to seat assembly 16. Backrest assembly 18 further includes backrest depth adjustment mechanism 39 for generally rectilinear relative movement between U-shaped backrest frame 34 and seat support structure 12, further discussed below. End portions 36 of backrest frame 34 may each include stationary portion 40 (FIG. 3) of backrest depth adjustment mechanism 39 (FIG. 3). Backrest assembly 18 additionally includes backrest 38 (FIG. 1) connected to backrest frame 34 to support the back of a seated user.

Backrest 38 may include a flexible elastomeric structural material having one or more rigid members embedded therein, which provide connection points for securing backrest 38 to backrest frame 34, and which allows backrest 38 to flexibly conform to the movement of a seated user, as discussed in detail in U.S. patent application publication No. U.S. 2003/0127896 A1, application Ser. No. 10/315,838, entitled CHAIR WITH LUMBAR SUPPORT AND CONFORMING BACK, filed on Dec. 10, 2002, and U.S. patent application Ser. No. 10/887,362, entitled CHAIR WITH LUMBAR SUPPORT AND CONFORMING BACK, filed on Jul. 8, 2004, each assigned to the assignee of the present invention, the disclosures of which are expressly incorporated herein by reference. Backrest 38 may also optionally include a cushion (not shown) attached thereto.

Seat assembly 16 is discussed in detail in U.S. patent application publication No. U.S. 2003/0137171 A1, application Ser. No. 10/315,590, entitled CHAIR WITH CONFORMING SEAT, filed on Dec. 10, 2002, assigned to the assignee of the present invention, the disclosure of which is expressly incorporated herein by reference. A ride mechanism by which seat assembly 16 and backrest assembly 18 are connected for synchronous movement is discussed in detail in U.S. patent application Ser. No. 10/915,882, entitled CHAIR RIDE MECHANISM WITH TENSION ASSEMBLY, filed on Aug. 11, 2004, assigned to the assignee of the present invention, the disclosure of which is expressly incorporated herein by reference.

Figure 4:
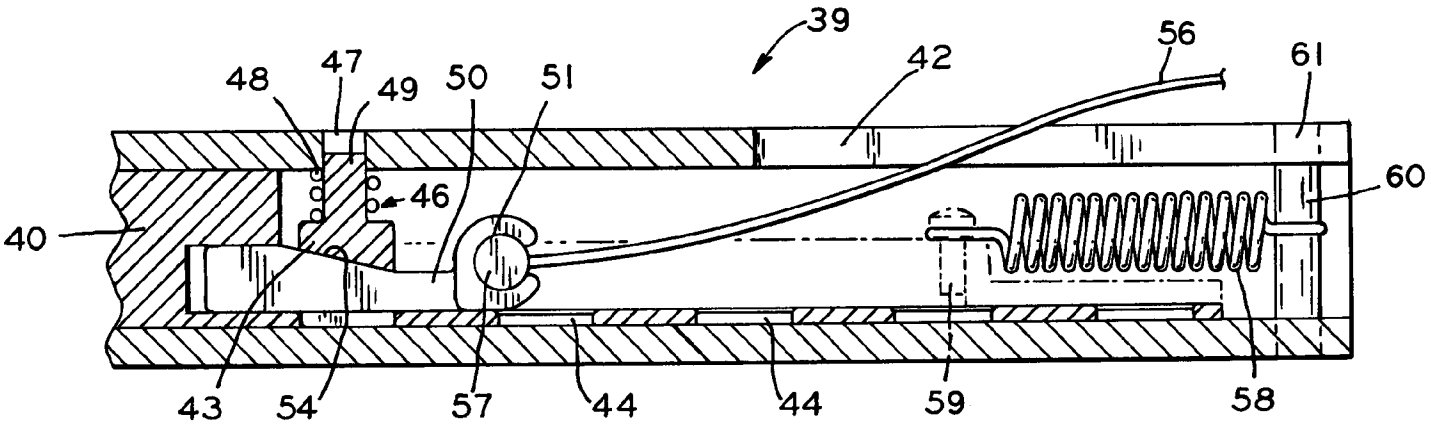
FIG. 4 is a cross-sectional view of a portion of the backrest depth adjustment mechanism of FIG. 3, showing the mechanism in a locked position with the movable portion fixed with respect to the stationary portion.

Referring now to FIG. 3, backrest depth adjustment mechanism 39 is shown in exploded view. Backrest depth adjustment mechanism 39 includes movable portion 40 and stationary portion 42. Backrest depth adjustment mechanism 39 also includes a selectively actuable backrest depth position lock mechanism connected between U-shaped backrest frame 34 and seat support structure 12. Stationary portion 42 is connected to yoke member 14 of seat support structure 12 (FIG. 1) and movable portion 40 is connected to end portion 36 of backrest frame 34 (FIG. 2). Alternatively, stationary portion 42 may be connected to end portion 36 of backrest frame 34 (FIG. 2) and movable portion 40 may be connected to yoke member 14 of seat support structure 12 (FIG. 1). In either embodiment, movable portion 40 is receivable within stationary portion 42 and includes track or recess 41 having a plurality of holes 44. Anchor portion 49 of pin 46 is receivable within hole 47 in stationary portion 42 and engagement or body portion 43 of pin 46 is normally biased by pin spring 48 into engagement with one of the plurality of holes 44 when movable portion 40 is stationary with respect to stationary portion 42, as shown in FIG. 4. Pin 46 includes groove 45 configured to receive cam surface 54 of slide member 50 for translating pin 46 as described below.

Slide member 50 is slidably mounted within recess 41 of movable portion 40 and includes cam surface 54. Actuator cable 56 includes end 57 received within holder 51 of slide member 50, and is translated to control the position of slide member 50 as described below. A user-controlled actuator mechanism (not shown) is operable to translate actuator cable 56, and may be configured as an actuation lever, a rotating wheel, or a pushbutton mechanism, for example. The actuator mechanism may be accessed on, or extend through, an exterior surface of an end portion 36 of backrest frame 34, for example. Main spring 58 includes one end connected by anchor pin 60 to stationary portion 42, and an opposite end connected by pin 59 to movable portion 40. Main spring 58 normally biases movable portion 40 toward or into stationary portion 42.

Figure 5:
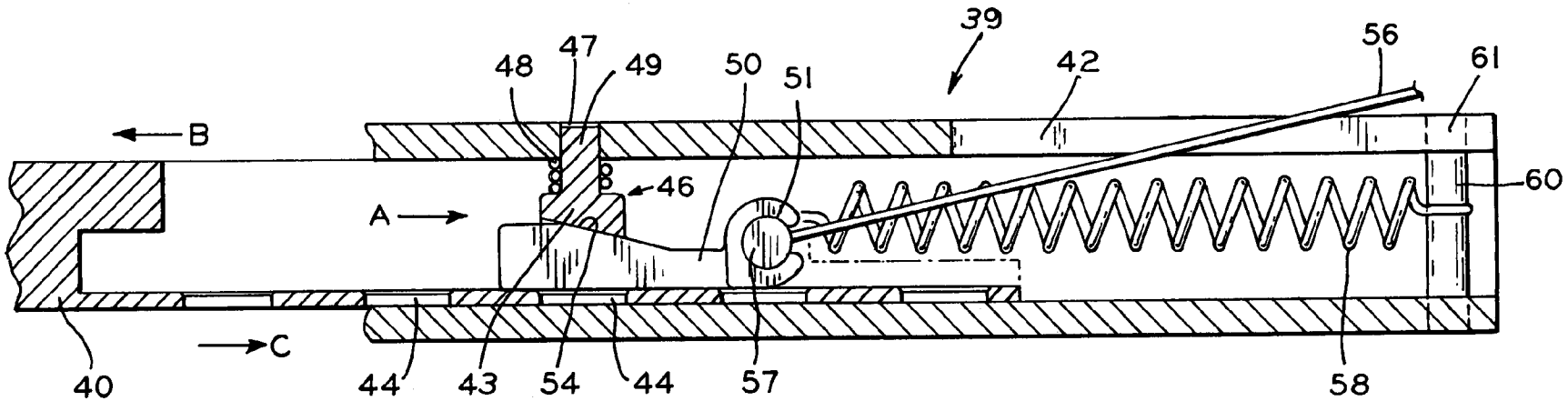
FIG. 5 is a cross-sectional view of a portion of the backrest depth adjustment mechanism of FIG. 3, showing the pin disengaged from the movable portion wherein the movable portion is slidably movable with respect to the stationary portion.
Figure 7:
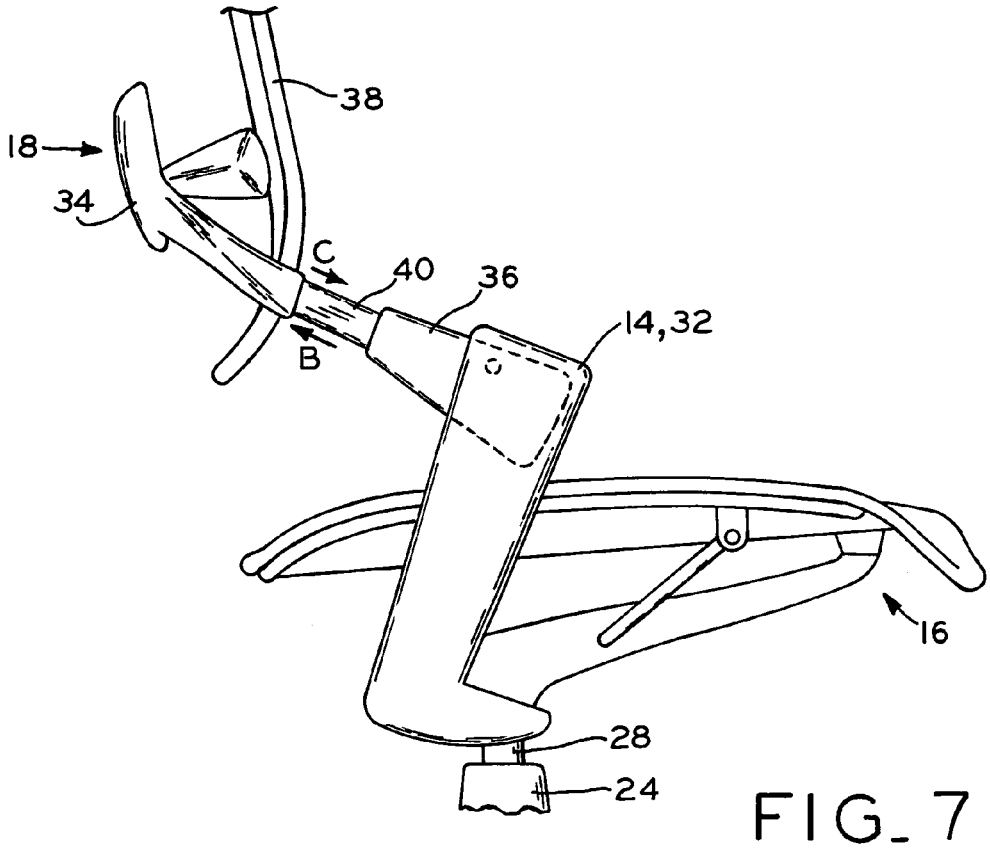
FIG. 7 is a fragmentary right side view of a portion of the chair of FIG. 1, showing the backrest assembly in a rearward position as compared to the position shown in FIG. 6.

Referring now to FIGS. 5 and 7, when a user desires to move backrest 38 in a rearward direction as indicated by Arrow B in FIG. 7, the user translates actuator cable 56 via the actuator mechanism (not shown). Referring now to FIG. 5, end 57 of actuator cable 56 in turn translates slide member 50 in the general direction of Arrow A when the actuator mechanism actuates actuator cable 56. Cam surface 54 of slide member 50 pushes pin 46 against the bias of pin spring 48 thereby moving body portion 43 of pin 46 out of engagement with hole 44 of movable portion 40 and biasing anchor portion 49 into further engagement with hole 47. Once body portion 43 of pin 46 is disengaged from hole 44 of recess 41 (FIG. 5), movable portion 40 may be moved against the bias of main spring 58 in the general direction of Arrow B by a user exerting force on backrest 38 in the general direction of Arrow B, such as by the user leaning rearwardly against backrest 38.

A user releases the actuator mechanism once the user has moved backrest 38 to a desired backrest position. Upon release of the actuator mechanism, pin spring 48 biases pin 46 toward cam surface 54 of slide member 50. Since the actuator mechanism is no longer applying force against the bias of pin spring 48, groove 45 of pin 46 engages and forces cam surface 54 of slide member 50 to move in a direction opposite of the direction indicated by Arrow A in FIG. 5. Once slide member 50 is moved, pin spring 48 biases anchor portion 49 of pin 46 outwardly from hole 47, however, anchor portion 49 of pin 46 is never completely removed from engagement with hole 47. If body portion 43 of pin 46 is lined up with one of the plurality of holes 44 of movable portion 40 upon release of the actuator mechanism, body portion 43 of pin 46 immediately engages a hole 44 whereupon movable portion 40 is locked into a fixed position with respect to stationary portion 42. If body portion 43 of pin 46 is not lined up with one of the plurality of holes 44 upon release of the actuator mechanism, main spring 58 biases movable portion 40 in the general direction indicated by Arrow C in FIG. 5 until body portion 43 of pin 46 lines up with a hole 44 whereupon body portion 43 of pin 46 will engage the hole 44 and lock movable portion 40 into a fixed position with respect to stationary portion 42.

Figure 6:
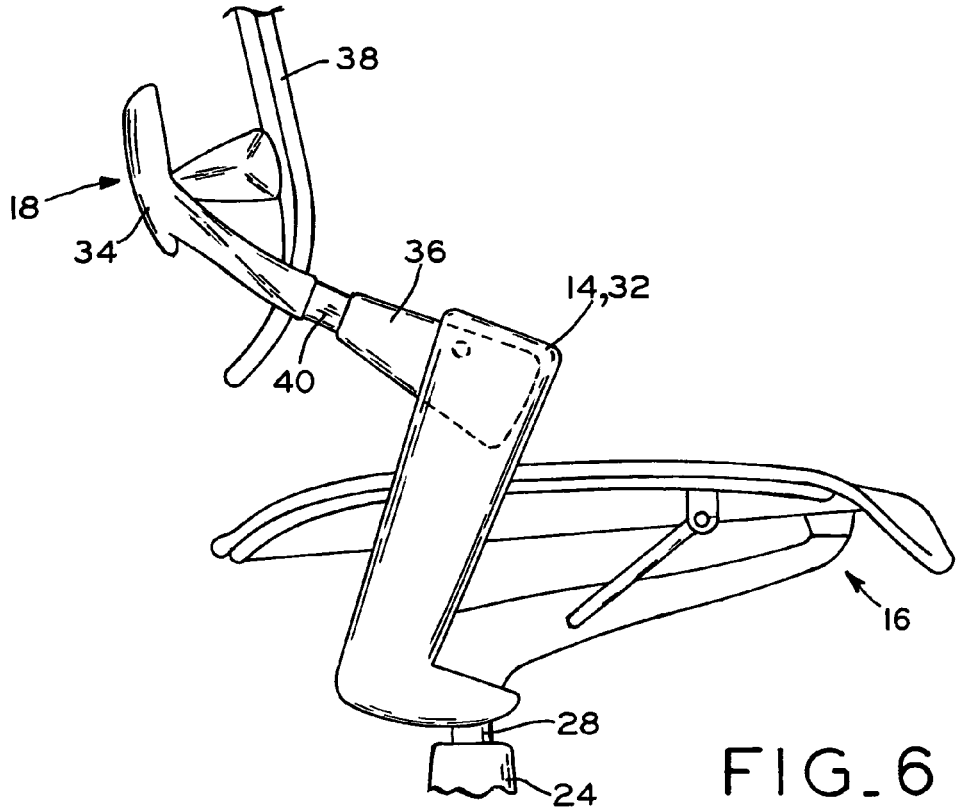
FIG. 6 is a fragmentary right side view of a portion of the chair of FIG. 1, showing the backrest assembly in a generally forward position.

Referring now to FIGS. 5 and 7, when a user desires to move backrest 38 in a forward direction as indicated by Arrow C in FIG. 7, the user translates actuator cable 56 via the actuator mechanism (not shown). Referring now to FIG. 5, end 57 of actuator cable 56 in turn translates slide member 50 in the general direction of Arrow A when the actuator mechanism actuates actuator cable 56. Cam surface 54 of slide member 50 pushes pin 46 against the bias of pin spring 48 thereby moving body portion 43 out of engagement with hole 44 of movable portion 40 and biasing anchor portion 49 into further engagement with hole 47. Once body portion 43 of pin 46 is disengaged from hole 44 of recess 41 (FIG. 5), movable portion 40 may be moved in the general direction of Arrow C by the bias force exerted on movable portion 40 by main spring 58. Thereafter, when a user removes rearward-directed force from backrest 38, such as by the user leaning forwardly away from backrest 38, backrest 38 is biased by main spring 58 in a forward direction to a location shown in FIG. 6, for example.

A user releases the actuator mechanism once the user has moved backrest 38 to a desired backrest position. Upon release of the actuator mechanism, pin spring 48 biases pin 46 toward cam surface 54 of slide member 50. Since the actuator mechanism is no longer applying force against the bias of pin spring 48, groove 45 of pin 46 forces cam surface 54 of slide member 50 to move in a direction opposite of the direction indicated by Arrow A in FIG. 5. Once slide member 50 is moved, pin spring 48 biases anchor portion 49 of pin 46 outwardly from hole 47. If body portion 43 of pin 46 is lined up with one of the plurality of holes 44 of movable portion 40 upon release of the actuator mechanism, body portion 43 of pin 46 immediately engages a hole 44 whereupon movable portion 40 is locked into a fixed position with respect to stationary portion 42. If body portion 43 of pin 46 is not lined up with one of the plurality of holes 44 upon release of the actuator mechanism, main spring 58 biases movable portion 40 in the general direction indicated by Arrow C in FIG. 5 until body portion 43 of pin 46 lines up with a hole 44 whereupon body portion 43 of pin 46 will engage the hole 44 and lock movable portion 40 into a fixed position with respect to stationary portion 42.

In this manner, the user may selectively adjust the depth of backrest 38 for generally rectilinear relative movement between backrest frame 34 and seat support structure 12, as opposed to adjusting the seat in a front-to-back manner as in the seat depth adjustment mechanisms of prior chairs. The selective depth adjustment of backrest 38 of the present invention provides the advantage of removing mechanically complex adjustment mechanisms from beneath the seat, thereby decreasing manufacturing difficulties of the mechanism and increasing the ease of use of the mechanism by a user of the chair.

Although the description above details the operation and structure of only one backrest depth adjustment mechanism 39, an identical mechanism may be located within opposite end portion 36 on the opposite side of task chair 10 wherein, in operation, both of the mechanisms could work in tandem with simultaneous actuation. In the alternative, one end portion 36 of backrest frame 34 may include a backrest depth adjustment mechanism, and the opposite end portion 36 may include a simplified follower mechanism including only stationary portion 42, movable portion 40, and main spring 58 without any other components, thereby reducing the amount of total components of the assembly.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A chair, comprising:

seat support structure;

a seat assembly supported by said seat support structure;

a backrest assembly, comprising:

a generally U-shaped member having a pair of end portions;

a backrest supported by said U-shaped member; and a backrest depth adjustment mechanism connecting at least one of said end portions to said seat support structure for generally rectilinear relative movement between said U-shaped member and said seat support structure, said depth adjustment mechanism including a selectively actuable backrest depth position lock mechanism connected between said U-shaped member and said seat support structure, wherein said backrest depth adjustment mechanism further comprises:

a stationary portion connected to one of said end portions and said seat support structure; and a movable portion connected to the other of said end portions and said seat support structure, said movable portion selectively movable with respect to said stationary portion whereby a backrest depth position of said U-shaped member and said backrest with respect to said seat assembly may be adjusted; and a main spring connecting said stationary portion and said movable portion, said main spring normally biasing said movable portion toward said stationary portion.

2. The chair of claim 1, wherein said seat assembly includes a pair of upwardly-extending portions respectively connected to said end portions of said U-shaped member.

3. The chair of claim 1, wherein said backrest depth adjustment mechanism further comprises:

a recess in said movable portion including a plurality of holes;

a pin disposed in said stationary portion, said pin dimensioned for engagement with individual ones of said holes; and a translatable slide member disposed in said recess in operative engagement with said pin.

4. The chair of claim 3, further comprising a pin spring normally biasing said pin into engagement with one of said plurality of holes, thereby locking said movable portion in a fixed position with respect to said stationary portion.

5. The chair of claim 3, wherein said slide member is translatable to bias said pin out of engagement with one of said plurality of holes, thereby permitting movement of said movable portion with respect to said stationary portion.

6. The chair of claim 1, wherein said seat support structure comprises a base assembly including a base having a plurality of arms projecting from a hub of said base, each of said arms including a wheel.

7. The chair of claim 1, wherein said backrest depth position lock mechanism is located at or above said seat support structure.

8. A chair, comprising:

seat support structure;

a seat assembly supported by said seat support structure, said seat assembly including a pair of upwardly-extending side portions;

a backrest assembly, comprising:

a generally U-shaped member having a pair of end portions pivotally connected to respective said side portions of said seat assembly;

a backrest supported by said U-shaped member; and a backrest depth adjustment mechanism associated with at least one of said end portions of said U-shaped member for generally rectilinear relative movement between said U-shaped member and said seat support structure, said backrest depth adjustment mechanism including a selectively actuable backrest depth position lock mechanism connected between said U-shaped member and said seat support structure, wherein said backrest depth adjustment mechanism comprises:

at least one stationary portion connected to one of said end portions of said U-shaped member and said side portions of said seat support structure: and at least one movable portion connected to the other of said end portions of said U-shaped member and said side portions of said seat support structure, said movable portion selectively movable with respect to said stationary portion whereby a backrest depth position of said U-shaped member and said backrest with respect to said seat assembly may be adjusted; and a main spring connecting said stationary portion and said movable portion, said main spring normally biasing said movable portion toward said stationary portion.

9. The chair of claim 8, wherein said backrest depth adjustment mechanism further comprises:

a recess in said movable portion including a plurality of holes;

a pin disposed in said stationary portion, said pin dimensioned for engagement with individual ones of said holes; and a translatable slide member disposed in said recess in operative engagement with said pin.

10. The chair of claim 9, further comprising a pin spring normally biasing said pin into engagement with one of said plurality of holes, thereby locking said movable portion in a fixed position with respect to said stationary portion.

11. The chair of claim 9, wherein said slide member is translatable to bias said pin out of engagement with one of said plurality of holes when said actuator mechanism is actuated, thereby permitting movement of said movable portion with respect to said stationary portion.

12. The chair of claim 8, wherein said seat support structure comprises a base assembly including a base having a plurality of arms projecting from a hub of said base, each of said arms including a wheel.

13. The chair of claim 8, wherein said backrest depth position lock mechanism is located at or above said seat support structure.

14. A chair, comprising:

seat support structure;

a seat assembly supported by said seat support structure;

a backrest assembly, including a generally U-shaped member having a pair of end portions, and a backrest supported by said U-shaped member; and a backrest depth adjustment mechanism connecting at least one of said end portions to said seat support structure for generally rectilinear relative movement between said U-shaped member and said seat support structure, said depth adjustment mechanism comprising:

a stationary portion connected to one of said end portions and said seat support structure;

a movable portion connected to the other of said end portions and said seat support structure, said movable portion selectively movable with respect to said stationary portion whereby a backrest depth position of said U-shaped member and said backrest may be adjusted with respect to said seat assembly; and a selectively actuable backrest depth position lock mechanism connected between said U-shaped member and said seat support structure, wherein said backrest depth adjustment mechanism further comprises:

a recess in said movable portion including a plurality of holes;

a pin disposed in said stationary portion, said pin dimensioned for engagement with individual ones of said holes;

a pin spring normally biasing said pin into engagement with one of said plurality of holes, thereby locking said movable portion in a fixed position with respect to said stationary portion; and a slide member disposed in said recess in operatively engagement with said pin.

15. The chair of claim 14, wherein said slide member is translatable to bias said pin out of engagement with one of said plurality of holes, thereby permitting movement of said movable portion with respect to said stationary portion.

16. The chair of claim 15, further comprising a main spring connecting said stationary portion and said movable portion, said main spring normally biasing said movable portion toward said stationary portion.

17. The chair of claim 14, wherein said seat support structure comprises a base assembly including a base having a plurality of arms projecting from a hub of said base, each of said arms including a wheel.

18. The chair of claim 14, wherein said backrest depth position lock mechanism is located at or above said seat support structure.

19. A chair, comprising:

seat support structure including a pair of upwardly-extending side portions;

a seat assembly supported by said seat support structure;

a backrest assembly, comprising:

a frame member having a pair of end portions pivotally coupled to said side portions of said seat support structure for reclining movement at a pair of respective pivot locations disposed above said seat assembly;

a backrest supported by said frame member; and a backrest depth adjustment mechanism connecting said frame member to said seat support structure for generally rectilinear relative movement between said frame member and said seat support structure, said depth adjustment mechanism including a selectively actuable backrest depth position lock mechanism connected between said frame member and said seat support structure.

20. The chair of claim 19, wherein said backrest depth adjustment mechanism further comprises:

a stationary portion connected to one of said frame member and said seat support structure; and a movable portion connected to the other of said frame member and said seat support structure, said movable portion selectively movable with respect to said stationary portion whereby a backrest depth position of said member and said backrest with respect to said seat assembly may be adjusted.

21. The chair of claim 20, further comprising a main spring connecting said stationary portion and said movable portion, said main spring normally biasing said movable portion toward said stationary portion.

22. The chair of claim 20, wherein said backrest depth adjustment mechanism further comprises:

a recess in said movable portion including a plurality of holes;

a pin disposed in said stationary portion, said pin dimensioned for engagement with individual ones of said holes; and a translatable slide member disposed in said recess in operative engagement with said pin.

23. The chair of claim 22, further comprising a pin spring normally biasing said pin into engagement with one of said plurality of holes, thereby locking said movable portion in a fixed position with respect to said stationary portion.

24. The chair of claim 22, wherein said slide member is translatable to bias said pin out of engagement with one of said plurality of holes, thereby permitting movement of said movable portion with respect to said stationary portion.

25. The chair of claim 19, wherein said backrest depth position lock mechanism is located at or above said seat support structure.

26. A chair, comprising:

seat support structure;

a seat assembly supported by said seat support structure;

a backrest assembly, comprising:

a frame member including a pair of end portions connected to said seat support structure;

a backrest supported by said frame member; and a backrest depth adjustment mechanism connecting said frame member to said seat support structure and including means associated with only one of said frame member end portions for selectively adjusting a backrest depth position of said frame member and said backrest with respect to said seat assembly.

* * * * *